US006192817B1

(12) United States Patent
Dec et al.

(10) Patent No.: US 6,192,817 B1
(45) Date of Patent: Feb. 27, 2001

(54) MOTORIZED SURFBOARD

(76) Inventors: Andrzej Dec, 948 Rambling Dr., Rochester Hills, MI (US) 48307; Piotr Dec, 1536 Polonia Park, Windsor, Ontario (CA), N8Y 4V5

( * ) Notice: Subject to any disclaimer, the term of this patent is extended or adjusted under 35 U.S.C. 154(b) by 0 days.

(21) Appl. No.: 09/350,221

(22) Filed: Jul. 8, 1999

(51) Int. Cl.[7] ..... B63B 35/73
(52) U.S. Cl. ..... 114/55.56
(58) Field of Search ..... 114/55.5, 55.51, 114/55.54, 55.56, 55.57, 55.58, 270; 440/38, 46; 441/65, 74

(56) References Cited

U.S. PATENT DOCUMENTS

| | | | | |
|---|---|---|---|---|
| D. 276,994 | | 1/1985 | Montgomery et al. | D12/307 |
| D. 330,928 | | 11/1992 | Sameshima . | |
| D. 355,400 | | 2/1995 | Montgomery | D12/307 |
| 2,434,700 | | 1/1948 | Keckley . | |
| 3,262,413 | | 7/1966 | Douglas et al. . | |
| 3,292,373 | * | 12/1966 | Tado | 60/221 |
| 3,324,822 | | 6/1967 | Carter, III . | |
| 3,369,518 | | 2/1968 | Jacobson . | |
| 3,426,724 | * | 2/1969 | Jacobson | 114/55.51 |
| 3,463,116 | | 8/1969 | Dawson . | |
| 3,481,303 | | 12/1969 | Tate et al. . | |
| 3,608,512 | | 9/1971 | Thompson . | |
| 3,882,815 | | 5/1975 | Bennett . | |
| 4,020,782 | | 5/1977 | Gleason . | |
| 4,237,812 | | 12/1980 | Richardson | 440/38 |
| 4,274,357 | | 6/1981 | Dawson . | |
| 4,321,048 | | 3/1982 | Marchese et al. | 440/32 |
| 4,457,724 | | 7/1984 | Miyamoto | 440/38 |
| 4,538,996 | | 9/1985 | Inwood | 440/38 |
| 5,017,166 | | 5/1991 | Chang | 440/7 |
| 5,096,446 | * | 3/1992 | Tazaki et al. | 440/38 |
| 5,254,024 | * | 10/1993 | Kobayashi et al. | 440/42 |
| 5,582,529 | | 12/1996 | Montgomery | 441/74 |
| 5,628,269 | * | 5/1997 | Henmi et al. | 114/183 R |

FOREIGN PATENT DOCUMENTS

| | | | | |
|---|---|---|---|---|
| 2617-793 | * | 1/1989 | (FR) | 114/55.5 |
| 1-148694 | * | 6/1989 | (JP) | 114/55.5 |
| 1-144284 | * | 6/1990 | (JP) | 114/55.5 |
| 3-295791 | * | 12/1991 | (JP) | 114/55.5 |

* cited by examiner

*Primary Examiner*—S. Joseph Morano
*Assistant Examiner*—Andrew Wright
(74) *Attorney, Agent, or Firm*—Bliss McGlynn, P.C.

(57) ABSTRACT

A powered surfboard includes a board defining a stem and a stern. An internal combustion engine is housed within the board closer to the stern than the stem. The exhaust system extends fore of the internal combustion before it bends back on itself and terminates at a position aft of the bend. This configuration acts as a valve in that, under typical operating conditions, water will not pass through the exhaust system to reach the internal combustion engine. The internal combustion engine is connected to a pump which receives the force produced by the internal combustion engine to force water to pass therethrough propelling the powered surfboard forward. The pump and the internal combustion engine are connected to the same interior surface of the hull of the board to reduce the amount of misalignment therebetween.

11 Claims, 3 Drawing Sheets

MOTORIZED SURFBOARD

BACKGROUND OF THE INVENTION

1. Field of the Invention

The invention relates to watercraft. More specifically, the invention relates to powered surfboards.

2. Description of the Related Art

Personal watercraft have given much pleasure to people who enjoy recreation and sports on navigable bodies of water. It has only been recent in the history of personal watercraft that motorized personal watercraft have made great strides in providing pleasure at a reasonable cost. These motorized personal watercrafts, the most common of which are wave runners and jet skis, have several disadvantages to their design. First, wave runners and jet skis are operated in a fashion such that they do not assimilate surfing, either wave surfing or wind surfing. This prevents the user of either of these watercrafts from working or using body balance as a primary source of direction. Essentially, the users of these craft steer the water jet propelling stream of water to move in a desired direction. Second, the weight of these watercraft are extreme. Typically, such watercraft require at least two people to move the watercraft when out of the water and require trailers for transport and/or launch. This restricts the use of these watercraft to only being used when two people are present to put the watercraft into and out of the water. U.S. Pat. No. 5,582,529, issued to Montgomery on Dec. 10, 1996, discloses a personal watercraft. This watercraft is singular in construction in that there are no secondary structures extending out from a primary structure. A deck is used by the operator to lay on or stand on as is desired by the operator. An internal combustion engine is housed in the center of this watercraft fore of the deck upon which the operator is positioned. Output and exhaust fumes are transmitted out of the internal combustion engine toward the stern of the watercraft. While this design more approximates surfing, it is not an optimal design. First, the internal combustion engine is housed in front of the deck for the operator and prevents the operator from guiding the watercraft with agility due to the displaced center of gravity of the watercraft and the operator to a position in front of the operator. While sharp edges protruding from the bottom of the hull (183A, 183B) were introduced into this watercraft to overcome this displaced center of gravity, these edges do little to overcome the displaced center of gravity to the position in front of the operator. Second, the watercraft is of a weight which requires at least two people to move the watercraft to and from the water. As stated above, this is a disadvantage especially in light of the fact that this watercraft is designed only to have a single operator on the deck thereof.

SUMMARY OF THE INVENTION AND ADVANTAGES

A watercraft for movement in water includes a board having a stem and a stern. An interior compartment is defined therebetween. A longitudinal axis extends through the board between the stem and the stern. The watercraft includes an internal combustion engine. The internal combustion engine is housed within the interior compartment of the board. The internal combustion engine generates an output force and exhaust fumes as a result of its consumption of fuel. The watercraft includes a pump which is connected to the internal combustion engine. The pump receives the force from the internal combustion engine to force a portion of the water therethrough. The watercraft includes an exhaust assembly which extends out from the internal combustion engine fore of the internal combustion engine toward the stem of the board.

One advantage associated with the invention includes the ability to operate a watercraft similar to that of a wave surfing watercraft or a wind surfing watercraft. Another advantage associated with the invention is the ability to generate a force to move the watercraft absent waves and/or wind. Still another advantage associated with the invention is a watercraft of reduced weight such that a single person may move the watercraft into and out of water. Yet another advantage associated with the invention is a watercraft having a center of gravity substantially in line with the center of gravity of the operator of the watercraft as the operator operates the watercraft.

BRIEF DESCRIPTION OF THE DRAWINGS

Other advantages of the invention will be readily appreciated as the same becomes better understood by reference to the following detailed description when considered in connection with the accompanying drawings, wherein.

DETAILED DESCRIPTION OF THE PREFERRED EMBODIMENT(S)

Figure 1:
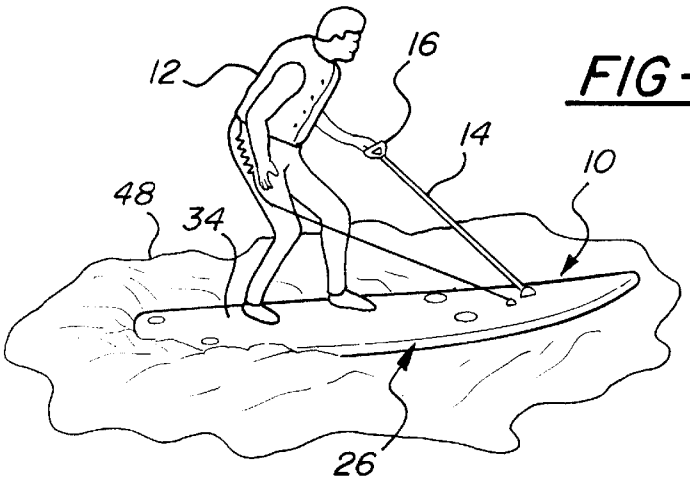
FIG. 1 is a perspective view of one embodiment of the invention as it is operated.

Referring to the Figures, a watercraft is generally indicated at 10. The watercraft 10 is a powered surfboard. The powered surfboard 10 is driven by an operator 12 who, as is shown in FIG. 1, may stand on the powered surfboard 10. The operator 12 will have a center of gravity which will extend over the back half of the powered surfboard 10. This center of gravity will be discussed in greater detail subsequently.

Figure 3:
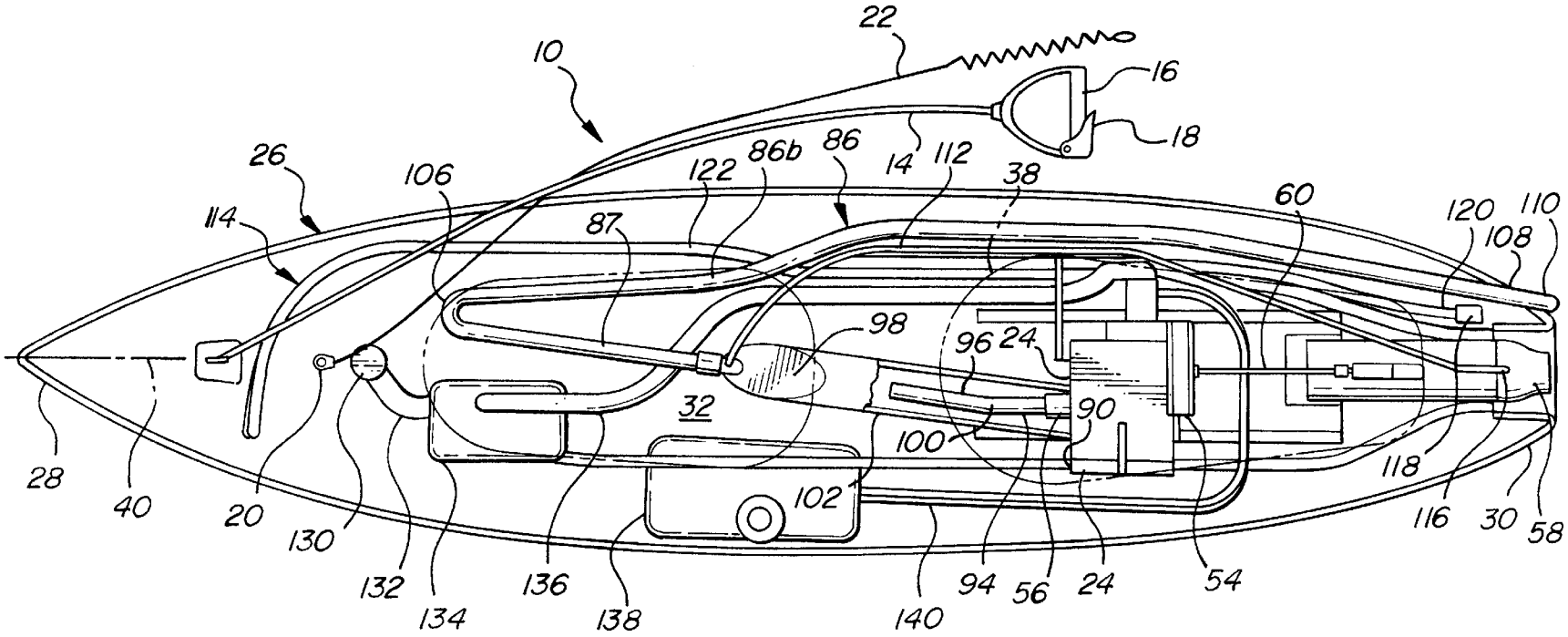
FIG. 3 is a top view of one embodiment of the invention with the top of the board removed therefrom.

The operator 12 controls the speed of the powered surfboard via a throttle cable 14. The throttle cable 14 includes a handle 16 which will have a throttle control device 18 (best shown in FIG. 3). An automatic disengagement switch 20 is remotely controlled by a disengagement cable 22 which is attached to the operator 12 during operation. If the operator 12 should fall off the powered surfboard 10, the disengagement cable 22, attached to the operator 12, will throw the automatic disengagement switch 20 to turn an internal combustion engine 24 off. The internal combustion engine 24 powers the powered surfboard 10 and will be discussed in greater detail subsequently. It may be appreciated by those skilled in the art that, in an alternative embodiment, the disengagement switch 20 may be a pressure button located on the throttle handle 16.

The powered surfboard 10 includes a board generally shown at 26. The board 26 defines a stem 28 and a stern 30. It may be appreciated by those skilled in the art that the stem 28 is often referred to as the bow and the stern 30 is often referred to as the tail. The board 26 defines an interior compartment 32 which is substantially enclosed by the board 26. The board 26 includes a deck 34 and a hull 36. The deck 34 will include an access door 38 to allow access to the interior compartment 32. The stem 28 and stern 30 define a longitudinal axis 40 which extends through the interior compartment 32 of the board 26.

The internal combustion engine 24 is housed within the interior compartment 32 of the board 26. The internal combustion engine 24 is mounted to an interior surface 42 of a bottom shell 44 of the hull 36. The bottom shell 44 also includes an exterior surface 46 upon which the board 26 rests on water 48.

More specifically, the internal combustion engine 24 rests on engine mounts 50 which extends out from the interior surface 42. The engine mounts 50 act as a platform and includes an angled surface 52 which is designed to provide an optimal output of the internal combustion engine 24 as it rests on the water 48.

The internal combustion engine 24 includes a flywheel 54 and an exhaust port 56. The flywheel 54, attached to a crank shaft (not shown), rotates when the internal combustion engine 24 is on.

A pump 58 is connected to the internal combustion engine 24 and receives the output force created by the internal combustion engine 24. The pump 58 is designed to push a portion of the water 48 upon which the board 26 rests therethrough in order that it may propel the powered surfboard 10 through the water 48 in a direction desired by the operator 12. The pump 58 is connected to the internal combustion engine 24 via a shaft 60 which may be fixedly secured to the flywheel 54 of the internal combustion engine 24. It should be appreciated by those skilled in the art that the shaft 60 may be connected to another portion of the internal combustion engine 24 other than the flywheel 54. The shaft 60 is connected to the flywheel 54 via a coupling 61 as a means to expediently connect the internal combustion engine 24 to the pump 58.

The pump 58 includes an inlet port 62 and an outlet port 64. Water 48 passes into the pump 58 through the inlet port 62 and out therefrom through the outlet port 64. An impeller 66 having a plurality of blades 67 is fixedly secured to the shaft 60. The rotation of the impeller 66 provides the necessary flow of the water 48 through an internal chamber 68 of the pump 58 which extends between the inlet 62 and outlet 64 ports. A nozzle 70 is disposed adjacent the outlet port 64 to control the direction of water 48 flowing through the pump 58.

The pump 58 is also secured to the interior surface 42 of the bottom shell 44. More specifically, because the pump 58 and the internal combustion engine 24 are fixedly secured to the same surface, i.e., the interior surface 42 of the bottom shell 44, the coupling 61 required to couple the impeller 66 and its impeller shaft 60 to the flywheel 54 is small and light-weight.

An inlet grate 82 covers the inlet port 62 of the pump 58. The inlet grate 82 protects the impeller 66 by preventing anything other than the water 48 from passing therethrough. The inlet grate 82 prevents objects from passing through the internal chamber 68. The inlet grate 82 is secured to the pump 58 by fasteners 84 (one shown). The inlet grate 82 and the pump 58 are designed such that the inlet grate 82 is flush with the external surface 46 and the bottom of the pump 58.

An exhaust assembly, generally shown at 86, is connected to the exhaust port 56 of the internal combustion engine 24. The exhaust assembly 86 extends out from the internal combustion engine 24 fore of the internal combustion engine 24 toward the stem 28 of the powered surfboard 10. More specifically, the exhaust assembly 86 includes a forward portion **86*a* which extends out from the exhaust port 56 toward the front of the powered surfboard 10. A return portion 86*b* extends back toward the stern 30. The exhaust assembly 86, including an exhaust pipe 87 which is connected to the exhaust port 56, extends in front of a plane 88 which represents a front face 90 of the internal combustion engine 24. The exhaust port 56 is located on the front face 90. Exhausting the exhaust fumes created by the internal combustion engine 24 fore of the internal combustion engine 24 results in the exhaust fumes traveling, at least at some point, in a direction that of the powered surfboard 10. More specifically, the exhaust fumes travel toward the stem 28 of the powered surfboard 10 before it exits the exhaust assembly 86 and the powered surfboard 10**.

In an alternative embodiment (not shown), the forward portion **86*a* would not be the first portion of the exhaust assembly 86 as shown in the Figures. In this alternative embodiment, the forward portion 86*a* extends both fore and aft the internal combustion engine 24 and/or the plane 88** thereof.

The exhaust assembly 86 includes an exhaust pipe extension 92. The exhaust pipe extension 92 is fixedly secured to the exhaust pipe 87. The exhaust pipe extension 92 is a tube including a first portion 94 which is fixedly secured to the exhaust pipe 87, a second portion 96 which extends out to a distal end 98 and an extension bend 100 disposed therebetween. Because the first portion 94 is extending upwardly toward the deck 34 due to the angle of the engine mounts 50, the bend 100 forces the second portion 96 to extend downwardly toward the bottom shell 44 of the board 26. The bend 100 allows the exhaust pipe extension 92 to be of a desired length without contacting the deck 34. In addition, the bend 100 acts as a trap requiring water 48 found inside the exhaust assembly 86 to increase a level greater than that of the bend 100 before the water 48 will enter the exhaust port 56 and damage the internal combustion engine 24. More specifically, the bend 100 acts as a valve preventing water 48 which may enter the exhaust assembly 86 from entering the internal combustion engine 24.

The exhaust assembly 86 also includes an expansion chamber 102. The expansion chamber 102 acts as a muffler deadening the noise generated by the internal combustion engine 24 when it combusts its fuel. The positioning of the distal end 98 of the exhaust pipe extension 92 up and away from the bottom wall of the expansion tube further magnifies the affect of a valve created by the bend 100 in the exhaust pipe extension 92 by being available to collect any water which may make it through the exhaust assembly 86.

Figure 2:
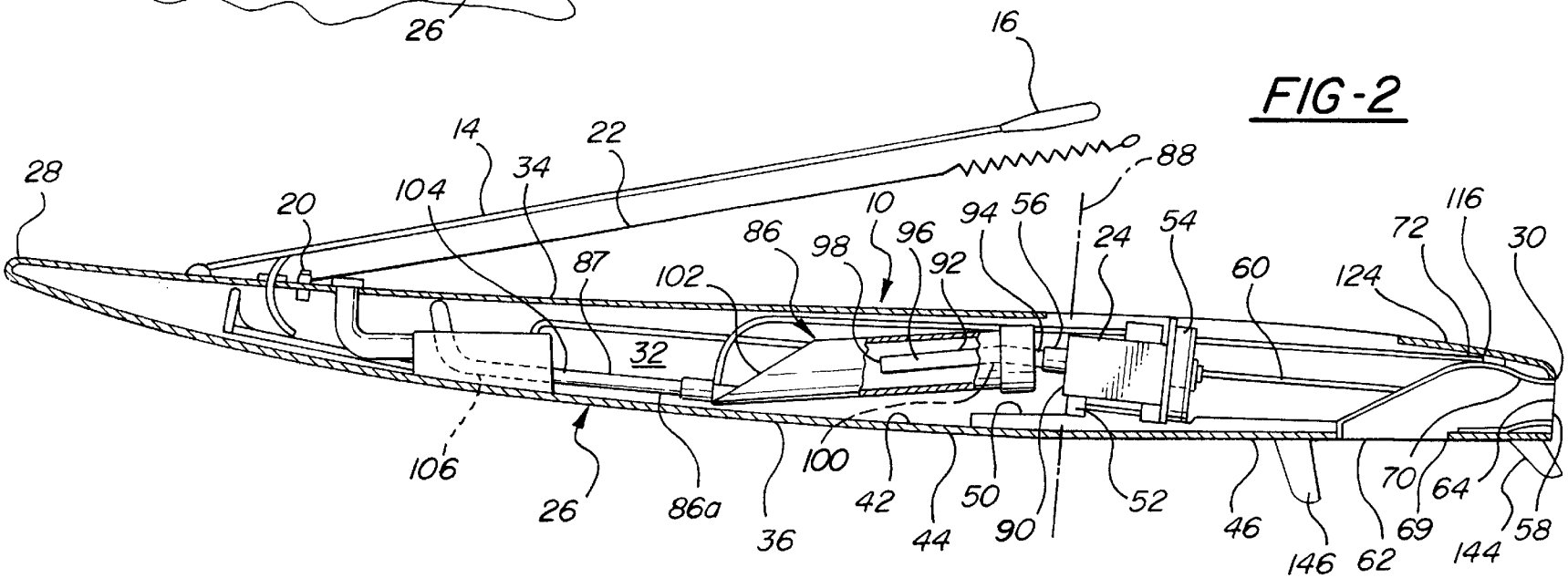
FIG. 2 is a cross-sectional side view of one embodiment of the invention.

The exhaust assembly 86 also includes an exhaust pipe 104 which extends even further toward the stem 28 of the board 26. The exhaust pipe 104 then bends back at an exhaust pipe bend 106 whereafter the exhaust pipe 104 traverses back past the internal combustion engine 24 toward the stern 30 of the board 26. The exhaust pipe bend 106 is closer to the stem 28 of the board 26 than the internal combustion engine 24. The exhaust pipe 104 extends to a location 108 aft of the internal combustion engine 24. In the embodiment shown in FIGS. 1 through 3, the exhaust pipe 104 ends at the stern 30 of the board 26. In a second embodiment shown in FIG. 4, the exhaust pipe 104 extends down through a first fin 144, discussed subsequently. The location 108 of the termination end 110 of the exhaust pipe 104 is located a distance from the longitudinal axis 40 of the board 26. This design allows for the exhaust pipe 104 to drain itself of any water which may have accumulated in the exhaust pipe 104 after the engine 24 stops when the board 26 is lifted and turned on its side utilizing the slope of the exhaust pipe 104 between the exhaust pipe bend 106 and the termination end 110.

The exhaust pipe bend 106 which is disposed adjacent the stem 28 also acts as a trap for any water 48 which may enter the termination end 110 of the exhaust pipe 104. More specifically, if the stern 30 is weighted down in the water 48 such that the stern 30 is below water 48, the stem 28 of the powered surfboard 10 is extending up into the air. This location of the stem 28 prevents water 48 from traveling up the exhaust pipe 104, past the exhaust pipe bend 106 and back down into the internal combustion engine 24. Likewise, if the stem 28 is weighted down such that the stem 28 is under water 48, the termination end 110 of the exhaust pipe 104 will be above the water 48 preventing water 48 from entering the exhaust pipe 104. The design of this exhaust assembly 86 eliminates any need for check valves which will reduce horse power and add weight, cost and complexity to the design of a powered surfboard 10.

A secondary pipe 112 extends between the exhaust pipe 104 at a location immediately adjacent the expansion tube 102 and the pump 58. The secondary pipe 112 injects water 48 from the pump 58 to further cool exhaust gases to reduce the noise level of the exhaust gases upon their discharge from the exhaust assembly 86.

A drainage assembly, generally shown at 114, removes any water 48 which may enter the interior compartment 32 of the board 26. The drainage assembly 114 drains water 48 out from the hull 36. The drainage assembly 114 is also connected to the pump 58 at a drain termination end 116. A filter 118 is disposed at a drain open end 120. A drain conduit 122 extends between the drain open end 120 and the drain termination end 116. The pump 58 applies the negative pressure it creates to the drainage assembly 114 such that the drainage assembly 114 collects all water 48 collecting inside the hull 36 and removes the water 48 through the pump 58.

A starting switch 130 is located between the stem 28 and the internal combustion engine 24. Conduit 132 extends between the starting switch 130 and a battery 134. Conduit 136 then extends the wires from the battery 134 to the internal combustion engine 24.

A fuel tank 138 stores the fuel to be combusted by the internal combustion engine 24. A fuel line 140 transports fuel from the fuel tank 138 to the internal combustion engine 24.

Figure 4:
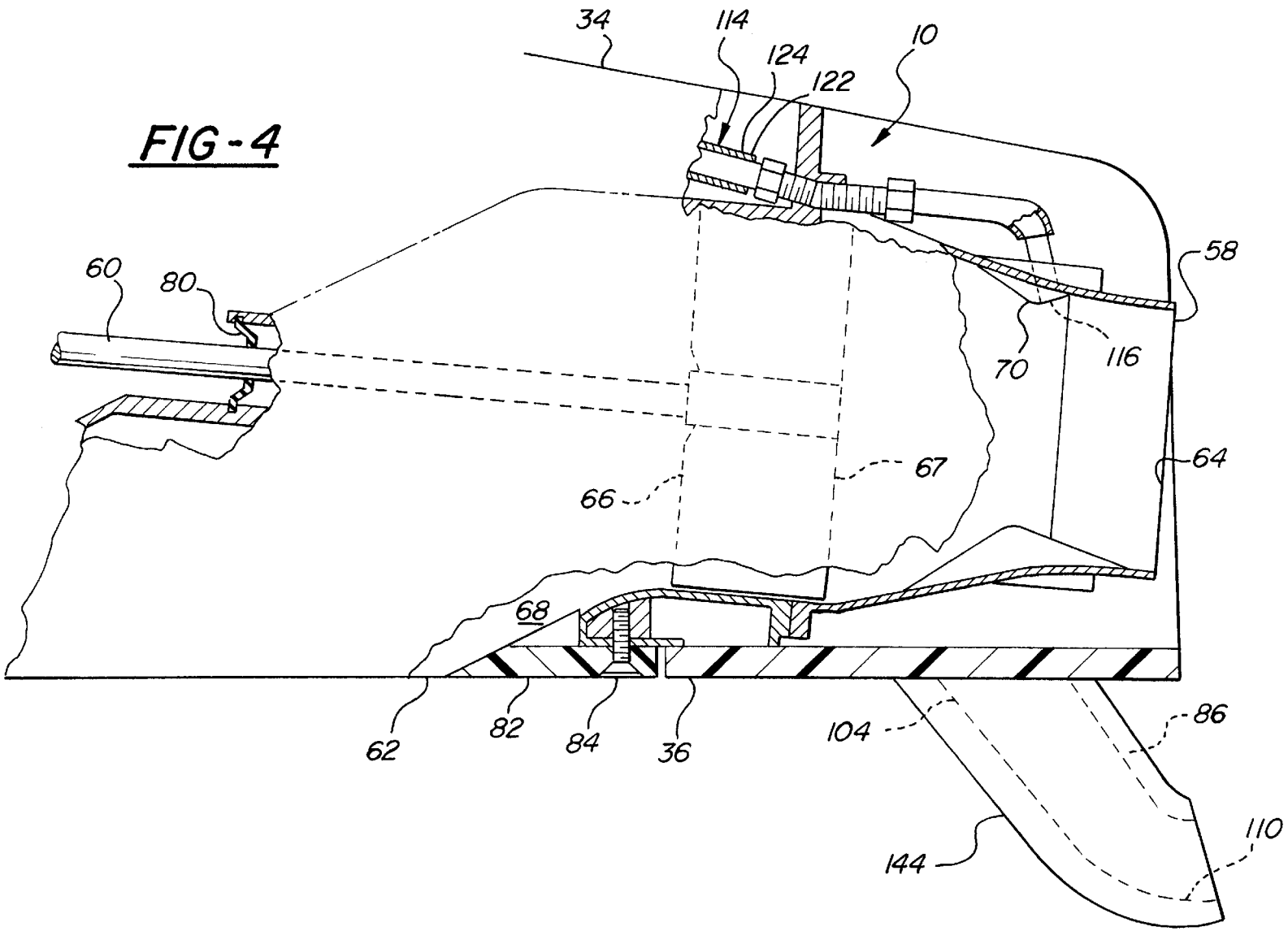
FIG. 4 is a side view partially cut away of one embodiment of a pump to be used with the invention.

As is shown in FIG. 4, a second embodiment of the exhaust assembly 86 is shown wherein the termination end 110 thereof extends down through the first fin 144. The first fin 144 extends down below the exterior surface 46 of the bottom shell 44 at a position directly below the pump 58. The first fin 144 extends out past the stern 30 of the board 26. When exhaust fumes are exiting the termination end 110 in this embodiment, the first fin 144 must extend past the stern 30 to prevent the exhaust fumes from entering the inlet port 62 of the pump 58. Gases entering the inlet port 62 reduce the output of the pump 58. Therefore, the first fin 144 must extend down and sufficiently past the stern 30 to ensure the exhaust fumes are not received by the pump 58. By placing the termination end 110 in the first fin 144, the noise generated by the powered surfboard 10 is drastically reduced enhancing the environment for all those using the powered surfboard 10.

A second fin 146 extends out from the bottom of the hull 36. The second fin 146 extends down below the exterior surface 46 of the bottom shell 44 and aids the operator 12 in directing the powered surfboard 10 as it traverses through the water 48.

The invention has been described in an illustrative manner. It is to be understood that the terminology which has been used is intended to be in the nature of words of description rather than of limitation.

Many modifications and variations of the invention are possible in light of the above teachings. Therefore, within the scope of the appended claims, the invention may be practiced other than as specifically described.

What is claimed is:

1. A watercraft for movement in water comprising:

a board having a stem and a stem and defining an interior compartment extending therebetween and a longitudinal axis therethrough;

an internal combustion engine housed within said interior compartment, said internal combustion engine generating an output force and exhaust fumes;

a pump connected to said internal combustion engine for receiving said output force to pump a portion of the water therethrough; and an exhaust assembly including an exhaust pipe extension having an extension bend and a expansion chamber to cool and muffle the exhaust fumes, said expansion chamber defining a top and a bottom, said expansion chamber having an inlet disposed adjacent said top of said expansion chamber and an outlet disposed adjacent said bottom of said expansion chamber wherein said exhaust pipe extension extends through said inlet of said expansion chamber in a manner such that said exhaust pipe extension is directed toward said outlet at said bottom of said expansion chamber due to said extension bend in said exhaust pipe extension.

2. A watercraft as set forth in claim 1 wherein said exhaust assembly further includes an exhaust pipe connected to said expansion chamber at said outlet and extending fore of said expansion chamber toward said stem.

3. A watercraft as set forth in claim 2 wherein said exhaust pipe includes an exhaust pipe bend disposed between said expansion chamber and said stem.

4. A watercraft as set forth in claim 3 wherein said exhaust pipe bend is closer to said stem than said internal combustion engine.

5. A watercraft as set forth in claim 4 wherein said exhaust pipe extends from said bend to a location aft of said exhaust pipe bend.

6. A watercraft as set forth in claim 5 wherein said location is spaced from said longitudinal axis of said board.

7. A watercraft as set forth in claim 6 wherein said board includes a hull having a bottom shell defining an exterior surface and an interior surface.

8. A watercraft as set forth in claim 7 wherein said internal combustion engine and said pump are fixedly secured to said interior surface of said bottom shell.

9. A watercraft as set forth in claim 8 wherein said pump includes an inlet port.

10. A watercraft as set forth in claim 9 including an inlet grate covering said inlet port allowing the portion of the water to pass through said pump, said inlet grate being substantially flush with said exterior surface of said bottom shell.

11. A watercraft as set forth in claim 4 wherein said exhaust pipe extends from said bend to a location aft of said internal combustion engine.

* * * * *